United States Patent [19]

Hirata et al.

[11] Patent Number: 4,785,152

[45] Date of Patent: Nov. 15, 1988

[54] TIMING CONTROL DEVICE FOR A MICROWAVE OVEN

[75] Inventors: Kengo Hirata, Nara; Kimie Morimoto, Osaka, both of Japan

[73] Assignee: Sharp Kabushiki Kaisha, Osaka, Japan

[21] Appl. No.: 117,041

[22] Filed: Nov. 3, 1987

[30] Foreign Application Priority Data

Dec. 23, 1986 [JP] Japan ..... 61-201990

[51] Int. Cl.[4] ..... H05B 6/68

[52] U.S. Cl. ..... 219/10.55 B; 219/10.55 M; 219/506; 99/325

[58] Field of Search ..... 219/10.55 B, 10.55 E, 219/10.55 R, 10.55 M, 492, 490, 506; 99/325, 327, 332, 335

[56] References Cited

U.S. PATENT DOCUMENTS

| | | | |
|---|---|---|---|
| 4,317,977 | 3/1982 | Buck | 219/10.55 B |
| 4,425,490 | 1/1984 | Takeda et al. | 219/10.55 B |
| 4,459,449 | 7/1984 | Hirata | 219/10.55 B |
| 4,568,810 | 2/1986 | Carmean | 219/10.55 B |

*Primary Examiner*—Philip H. Leung

*Attorney, Agent, or Firm*—Birch, Stewart, Kolasch & Birch

[57] ABSTRACT

A microwave oven comprising a power supply, a heating chamber having a door, a detector for detecting the opening and closing of the door, a high-frequency heater for heating the article to be heated, a plurality of setting keys for setting heating time, a timer for driving the heater for a specified period of time, a starter for initiating the timer into operation after a predetermined period of time beginning after the depression of the setting key, a stopper for temporarily preventing the operation of the timer when the cooking is interrupted by opening of the door, and a control unit for driving the timer again when the cooking operation is resumed on closing the door. The setting key functions also as a start key, and when the door is opened and closed during cooking, the article can be heated only for the rest of the heating time by depressing the original setting key. The heating time can also be adjustable to a new heating time.

12 Claims, 7 Drawing Sheets

TIMING CONTROL DEVICE FOR A MICROWAVE OVEN

BACKGROUND OF THE INVENTION

1. Field of the Invention

The present invention relates to a microwave oven having a microcomputer incorporated therein, and more particularly, to a microwave oven which uses simplified key manipulation.

2. Description of the Prior Art

Conventional microwave ovens are adapted to store cooking conditions upon setting heating time with a heating time setting key and entering an output power level and the like using other function keys and to thereafter start cooking upon depression of a start key. When the door is opened during the cooking cycle to interrupt the cooking, the remaining heating time is displayed and stored. When cooking is to be resumed, the start key is depressed again after closing the door, thereby continuing the cooking for the rest of the time. If it is desired to alter the initially set heating time after observing the state of the food being cooked during the interruption, the user must depress a clear key, store the new cooking conditions by setting the new desired heating time with the heating time setting key and the desired output power level and the like using function keys and thereafter depress the start key. For elaborate cooking, the conventional microwave oven thus requires a complex procedure, which entails a time loss and also manipulation errors when food is to be cooked quickly.

SUMMARY OF THE INVENTION

With reference to FIG. 1 which is a block diagram showing the construction of a microwave oven of the present invention, the oven comprises a heating chamber 1 having a door, high-frequency heating means 2 for heating food, detecting means 3 for detecting the opening and closing of the door, a plurality of setting keys 4 mounted on the front side of the door for setting the heating time, timer means 5 for measuring the time set by the setting key and for driving the high-frequency heating means 2 during its operation, start means 6 for initiating the timer means 5 into a time measuring operation at the end of a predetermined period of time after the depression of the setting key, stop means 7 for temporarily suspending the operation of the timer means 5 in response to an output from the detecting means 3 the cooking is interrupted by opening the door, and control means 8 for causing the timer means 5 to measure the rest of the heating time when one of the setting key 4 corresponding to the setting key 4 initially used for setting the heating time is despressed within a specified period of time after the door is closed to resume cooking, or for setting a new desired heating time or for adding a time interval corresponding to the other setting keys when said other keys are alternatively depressed, or for resetting the timer means 5 when none of the setting keys 4 are depressed.

According to the present invention, the start means 6 instructs the timer means 5 to start heating upon lapse of the predetermined period of time after the depression of the setting key 4, so that the start key of the conventional microwave oven can be dispensed with. This serves to reduce the number of setting keys 4 needed for setting cooking conditions, diminishing the space needed for the control panel to render the main body of the microwave oven compact and making the oven easy to operate.

Since the control means 8 has stored within it the conditions for cooking the food being treated even when the door is opened during cooking, the interrupted cooking operation can be continued by simple manipulation of the setting key 4.

When the state of the food being cooked is observed during the interruption, the subsequent heating time can be adjusted to a period different from the initially set heating time by manipulating the setting key 4.

It is desirable to provide display means in the vicinity of the setting keys 4 for indicating the heating time to be set by the setting key. Also, the setting key 4 preferably comprises a push-button switch or membrane switch.

DESCRIPTION OF THE PREFERRED EMBODIMENTS

An embodiment of the present invention will be described below with reference to the drawings.

Figure 1:
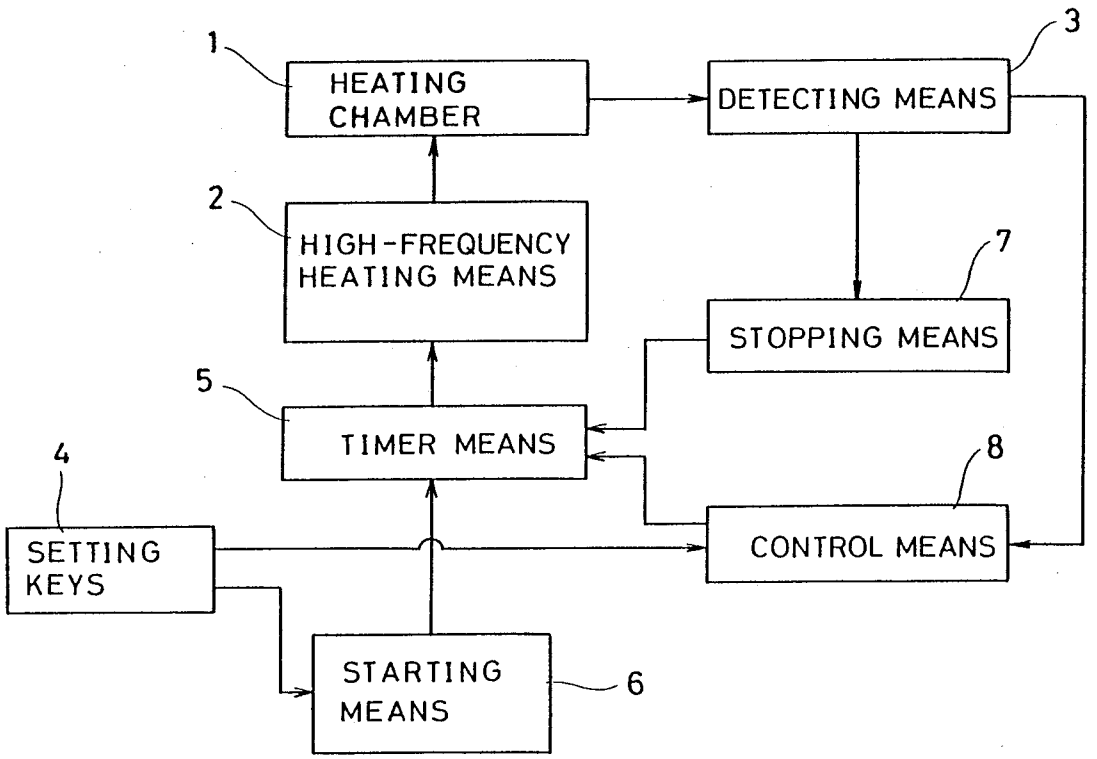
FIG. 1 is a block diagram showing the basic construction of microwave ovens of the invention.
Figure 2:
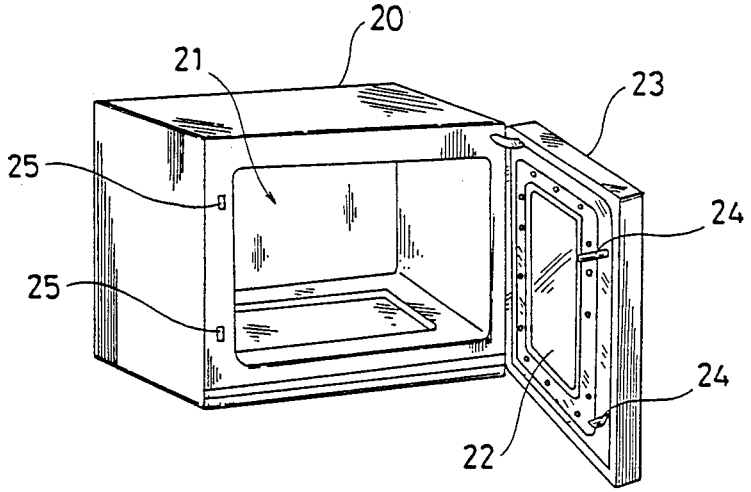
FIG. 2 is a perspective view showing the appearance of a microwave oven embodying the invention.

FIG. 2 shows the appearance of a microwave oven embodying the invention. With reference to this drawing, reference 20 is the main body of the oven. A heating chamber 21 is provided within the main body 20 for accommodating the article to be heated. Within the heating chamber 21, high-frequency electromagnetic waves are emitted by a magnetron (not shown) serving as heating means. Food (not shown) as the article to be heated is heated by the electromagnetic wave.

The heating chamber 21 has a front opening which comprising a door 23 having a transparent panel 22. Mounted on the inner wall of the door 23 are latch heads 24 each engageable with or disengageable from a latch hook 25 mounted to the flange of the main body 20 when the door 23 is closed or opened, respectively. The latch head 24 and the latch hook 25 are operatively connected to a switch, (not shown) thereby serving as means for detecting the opening and closing of the door 23.

Figure 3:
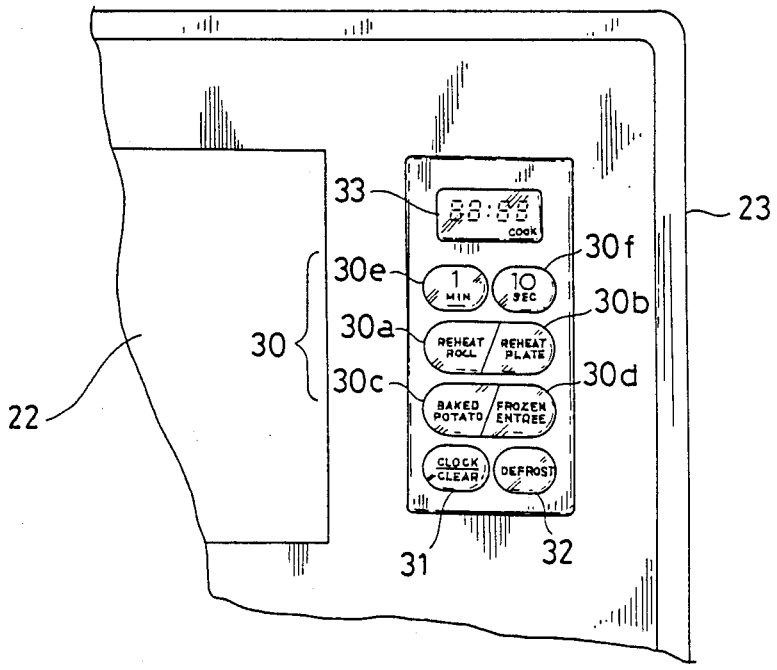
FIG. 3 is a front view showing an operation panel provided on the outer side of the door of the microwave oven shown in FIG. 2.

FIG. 3 is a front view showing an operation panel provided on the outer wall of the door 23. References 30*a* through 30*d* are a plurality of keys for setting cooking conditions. These keys include "REHEAT ROLL" key 30*a* for providing an output of 20-seconds of heating time when depressed once, "REHEAT PLATE" key 30*b* for providing heating time of 30 minutes and 30 seconds when depressed once, "BAKED POTATO" key 30*c* for causing an output of 6-minutes of heating time when depressed once, and "FROZEN ENTREE" key 30*d* for providing an output of 10-minutes of heating time when depressed once. Each of these keys 30*a* to 30*d* is preset to the specified heating time. On the other hand, setting keys 30*e* and 30*f* are provided for the user to set optional periods of heating time different from those set by the above setting keys 30*a* to 30*d*. The key 30*e* is "1 MIN" key by which 1-minute heating time is settable when it is depressed once. When the key 30*e* is depressed repeatedly, the heating time is increased by 1 minute increments relating to the number of times it is depressed. The key 30*f* is "10 SEC" key for setting heating time in 10-second units in the same manner as the 1 MIN key. When successively depressed, 1 MIN key increases the heating time by increments of 1 minute, and 10 SEC key by increments of 10 seconds. When 1 MIN key and 10 SEC key are used in combination, heating time is settable in minute and 10 second units.

References 31 and 32 are function keys. The key 31 is "CLOCK/CLEAR" key for causing the LCD readout, described below, to indicate the time of day and also for canceling an erroneous set heating time. The key 32 is "DEFROST" key for lowering the output power level to 30%. Reference 33 is the above-mentioned LCD readout which usually provides a clock display while the power supply is on. On depression of the setting key 30, the readout indicates the set heating time.

Figure 4:
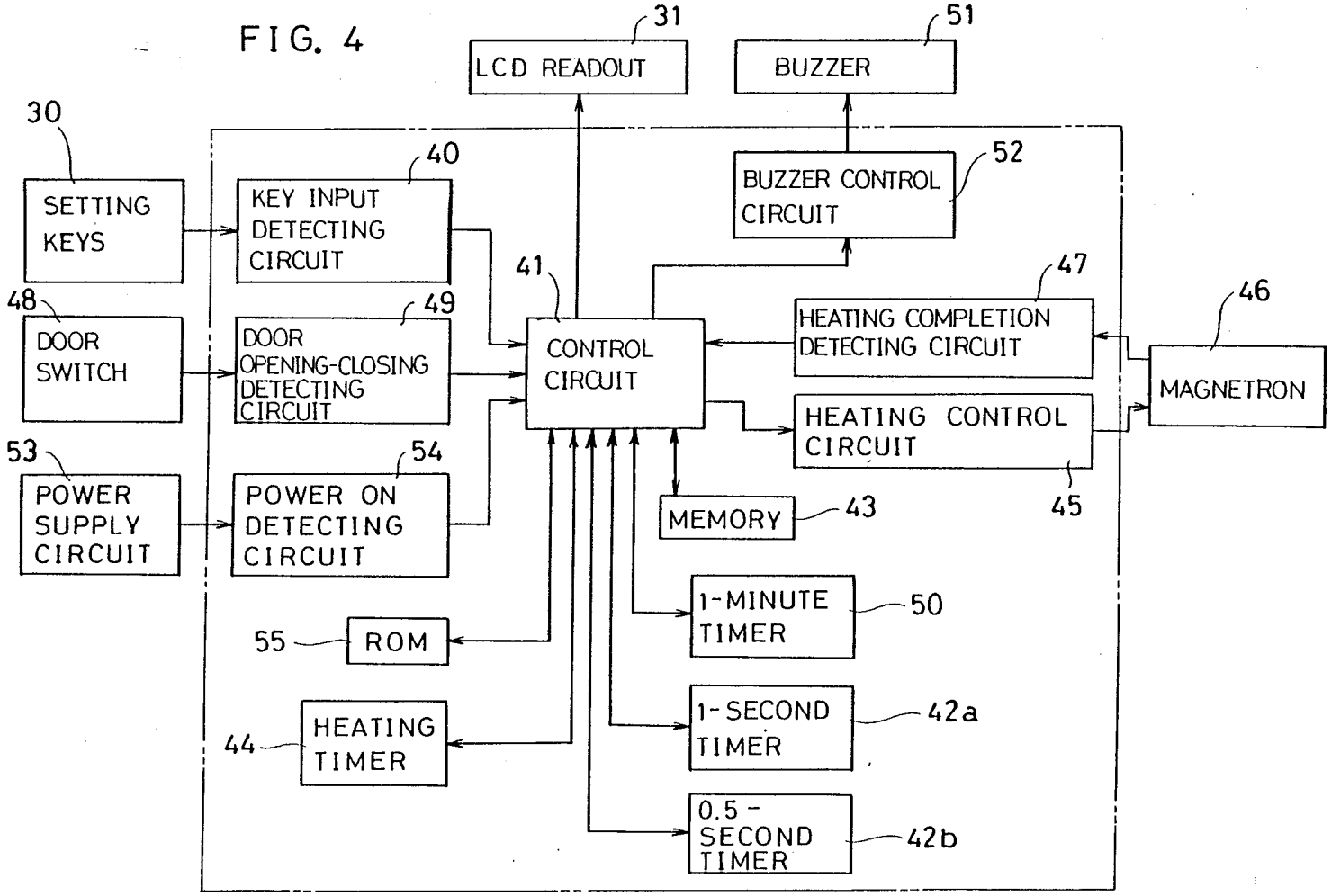
FIG. 4 is a block diagram showing the construction of the embodiment.

FIG. 4 is a block diagram showing the construction of the present embodiment.

Depression of any one of the plurality of setting keys 30 is detected by a key input detecting circuit 40 which feeds the key input is fed to a control circuit 41. The control circuit 41, which comprises a microcomputer, actuates a one-second timer 42*a* serving as first timer means for measuring a first predetermined time interval every time one of the setting keys 30 is depressed. When one of the setting keys 30 is depressed consecutively during the operation of the one-second timer 42*a*, the depression of one of the setting keys 30 causes the control circuit 41 to regard the inputs of the depressed setting keys 30 as effective and consecutively adds the periods of time represented by these setting keys 30 to calculate the desired heating time while at the same time resetting and starting the one-second 42*a* timer again in response to every input of the setting key. When the operation of the one-second timer 42*a* is completed after the depression of the final time setting key 30, the setting procedure is regarded as completed, whereupon the control circuit 41 stores the overall heating time entered and the kind of keys depressed 30 in a memory 43, sets the overall heating time in a heating timer 44 and actuates this timer 44. During the operation of the microwave oven, the heating timer 44 operates a magnetron 46 through a heating control circuit 45. Reference 42*b* is a 0.5-second timer operative when the 1 MIN key or 10 SEC key is held depressed. Completion of the operation of the magnetron 46 is detected by a heating completion detecting circuit 47, and a message to this effect is sent to the control circuit 41. Upon opening or closing the door 23, a door switch 48 produces a signal, which is then checked by a door opening-closing detecting circuit 49 as to whether the signal represents opening or closing. The result is sent to the control circuit 41. When the door opening-closing detecting circuit 49 detects that the door 23 is in its closed position, the control circuit 41 actuates a one-minute timer 50 serving as second timer means for measuring a second predetermined time interval. A buzzer 51 is turned on by a buzzer control circuit 52 to produce a sound signal, for example, when the setting key 30 is depressed properly or on completion of operation of the heating timer 44. Reference 53 is a power supply circuit for operating the system shown in FIG. 4, reference 54 is a circuit for detecting that the power supply is on, and reference 55 is a ROM that stores a program for controlling the control circuit 41. The circuit 41 executes a control process according to this program.

Figure 5:
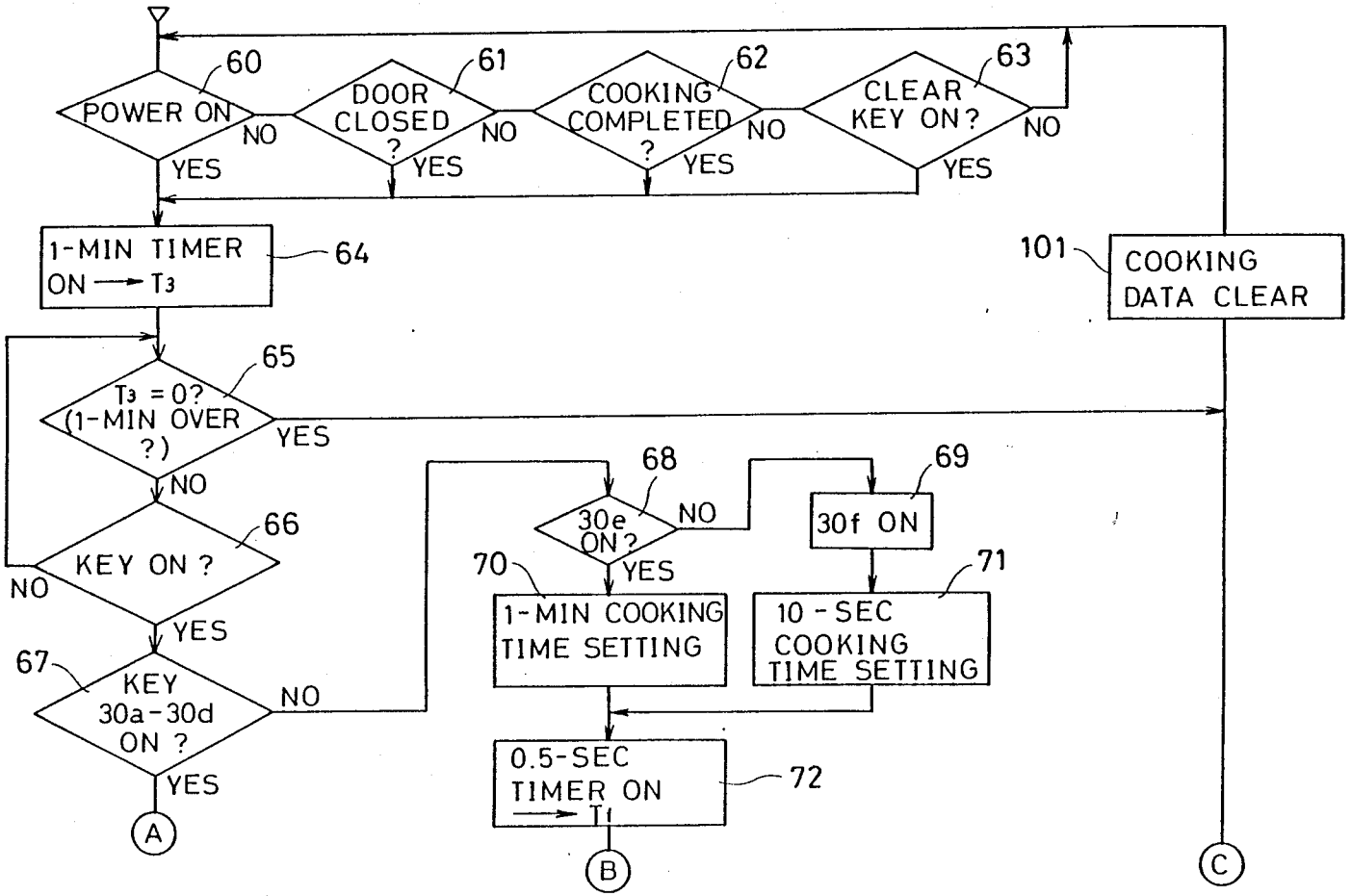
FIGS. 5(*a*)–5(*c*) are flow charts for illustrating the operation of the embodiment.
Figure 5:
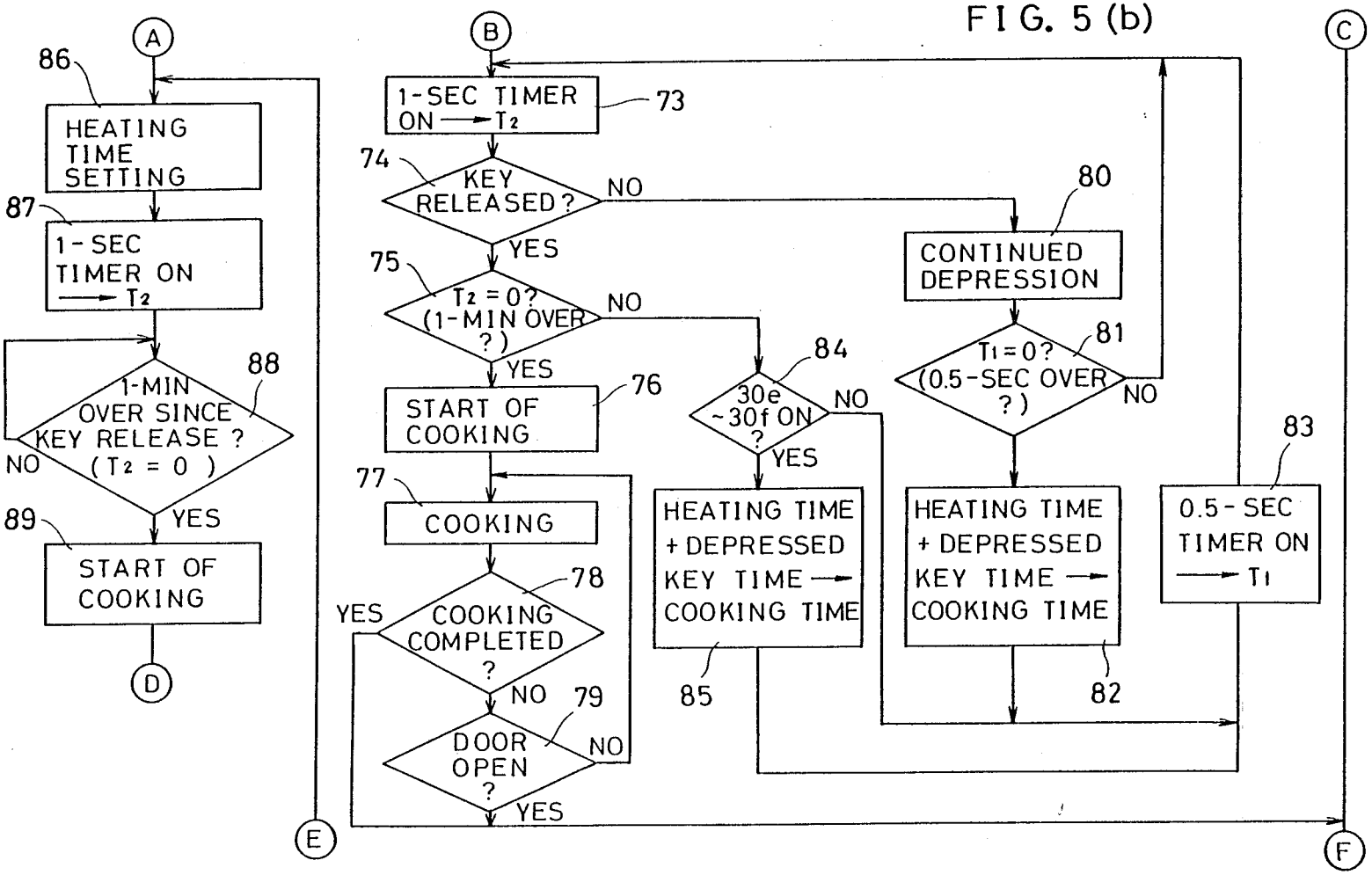
Figure 5C:
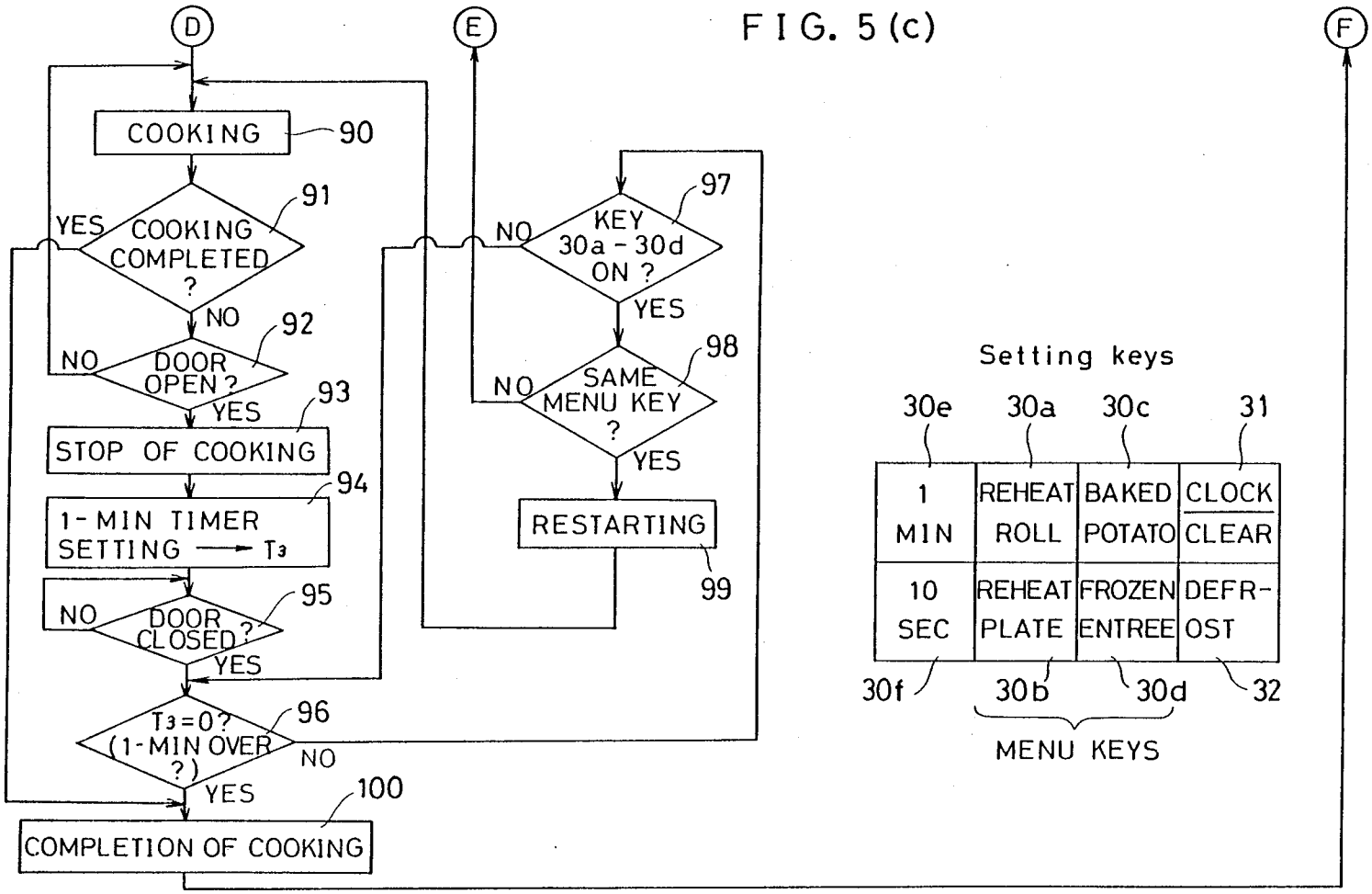

FIGS. 5(*a*)–(*c*) are flow charts showing the program stored in the ROM 55.

First, inquiries are made in succession as to whether the power supply is on (step 60), whether the door is closed (step 61), whether cooking is completed (step 62) and whether CLEAR key is depressed (step 63). When these inquires (steps 60 to 63) are answered in the affirmative, the one-minute timer 50 is actuated to count up 1 minute (step 64). With the start of the counting, step 65 checks whether 1 minute has elapsed. Step 67 checks whether one of the setting keys 30*a* to 30*d* is depressed within the 1 minute period (steps 66, 67). If the lapse of 1 minute is detected in step 65, the cooking data is erased (step 101), and the sequence returns to step 60. This eliminates the likelihood that the control circuit 41 will be operated when the setting key 30 is inadvertently depressed, thus assuring safety. When the inquiry of step 67 is answered in the negative, 1 MIN key 30*e* and 10 SEC key 30*f* are checked as to whether they are depressed (steps 68, 69). If 1 MIN key 30*e* is depressed, one-minute heating time is set (step 70). When 10 SEC key 30*f* is depressed, 10-second heating time is set (step 71). Subsequently, the timers 42*b* and 42*a* are set to 0.5 second and 1 second, respectively, in succession (steps 72, 73). Step 74 checks whether 1 MIN key 30*e* or 10 SEC key 30*f* has been released. Upon the lapse of 1 second after the release of the key, cooking is started (steps 75, 76, 77). If the door is opened during cooking, or the cooking is completed (steps 78, 79), the cooking data is cleared (step 101). When 1 MIN key 30*e* or 10 SEC key 30*f* is held depressed in step 74 for less than 0.5 second (steps 80, 81), step 73 follows. When the duration of depression is longer, the heating time to be set by the depressed key is added to the initial heating time upon lapse of every 0.5 second (steps 82→83→73→74→80→81→82). Further when step 75 detects that the one-second timer 42*a* has not reached 1 second, step 84 checks again whether the setting key 30*e* or 30*f* is in a depressed position. When the answer is in the affirmative, the heating time to be set by the key 30*e* or 30*f* concerned is added the number of time the key has been depressed (step 85) aside from the foregoing step following the continued depression of the key 30*e* or 30*f*.

The depression of one of the setting keys 30*a* to 30*d* in step 67 is followed by step 86 in which the predetermined heating time is set. The one-second timer 42*a* is then actuated in step 87. After detecting that 1 second has elapsed since the depressed key was released, cooking is started (steps 88, 89). Cooking (step 90) is then checked as to its completion (step 91). If the door is not opened at this time, cooking will be continued, whereas if the door is opened, the cooking operation is discontinued (steps 92, 93). If the cooking operation is interrupted for at least 1 minute, the one-minute timer 50 is set in step 94 to terminate the operation. Step 95 inquires whether the door is closed. With closing of the door, the one-minute timer 50 starts counting. Before one minute elapses (step 96), step 97 inquires whether a setting key has been depressed. If the answer is affirmative, step 98 checks whether the depressed key is the same as the setting key depressed for setting the initial heating time. When the answer to the inquiry is "YES," cooking is resumed for the rest of heating time (step 99), followed by step 90. If the depressed key is determined to be different in step 98 from the key depressed for setting the initial heating time, the sequence returns to step 86 in which a new heating time is set. On completion of cooking (step 100), the cooking data is cleared (step 101), followed by step 60.

Thus according to the present invention, no start key is need, thereby decreasing the number of keys for setting cooking conditions, rendering the oven easy to operate, diminishing the space needed for the operation assembly and thereby making the oven main body compact. Further because the settings for cooking remain without clearing even when the door is opened during cooking, the cooking operation can be resumed after an interruption by a simple procedure. The conditions set for cooking can be changed before resuming the cooking operation, so that it is possible to recognize the state of the food being cooked by opening the door during cooking and to set suitable conditions for the subsequent cooking operation based on the result.

Figure 6:
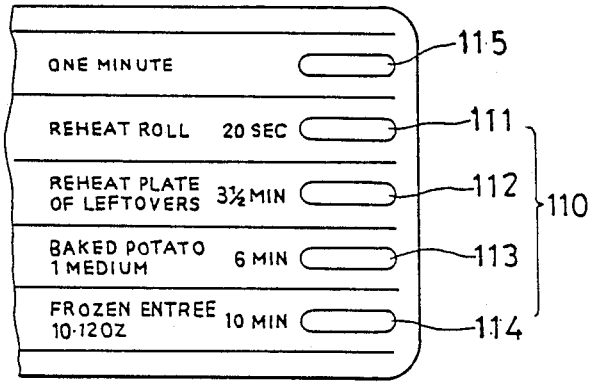
FIG. 6 is a front view showing another example of control panel for the embodiment.

FIG. 6 shows another embodiment of operation panel which has a plurality of setting keys 110 in the form of push buttons for setting cooking conditions. These keys include "REHEAT ROLL" key 111, "REHEAT PLATE OF LEFTOVERS" key 112, "BAKED POTATO" key 113 and "FROZEN ENTREE" key 114 which are preset to heating periods of 20 seconds, 3.5 minutes, 6 minutes and 10 minutes, respectively. Indicated at 115 is "ONE MINUTE" key for the user to set the desired heating time. This key is adapted to set one-minute heating time when depressed once.

What is claimed is:

1. A microwave oven comprising:

a heating chamber having a door;

high-frequency heating means for heating an article to be heated;

detecting means for detecting whether the door is open or closed and for producing a detection signal representing whether the door is open or closed;

a plurality of setting keys for setting heating time;

timer means, operatively connected to said plurality of setting keys, for measuring said heating time set by said setting keys and for driving said high-frequency heating means during the heating of the article;

start means, operatively connected to said timer means, for enabling said timer means to perform a time measuring operation for a predetermined period of time after a depression of one of said setting keys;

stop means, operatively connected to said timer means, for temporarily preventing the operation of said timer means in response to said detection signal which indicates that the door has been opened; and control means for causing said timer means to resume the heating of the article for the remainder of the heating time when one of said setting keys corresponding to the setting keys initially used for setting said heating time is depressed within a specified period of time, said specified period of time beginning upon receiving said detection signal indicating that the door is closed again;

said control means setting a new heating time or adding more time to the heating time, corresponding to another setting key, when another setting key not corresponding to the setting keys initially used for setting said heating time is alternatively depressed;

said control means resetting said timer means when none of said plurality of said setting keys are depressed within said specified period of time, thereby rendering said setting keys usable also as a start key and making it possible to heat the article only for the remainder of the heating time after the door is opened and closed during cooking, or rendering the cooking time variable by depressing said another setting keys within said specified period of time and enabling setting a new heating time to replace the remainder of the old heating time.

2. The microwave oven as defined in claim 1, wherein said setting keys comprise push-button switches or membrane switches.

3. The microwave oven as defined in claim 1, further comprising display means for indicating the heating time set by said setting keys.

4. The microwave oven as defined in claim 3, wherein said display means indicates totaled heating time when said setting keys are depressed a plurality of times or continuously.

5. The microwave oven as defined in claim 1, further comprising notifying means for producing a sound signal upon depression of said setting keys.

6. The microwave oven as defined in claim 1, wherein said detecting means determines the detection of the opening and closing of the door by disengagement and engagement of a lock mechanism for locking the door.

7. The microwave oven as defined in claim 1, further comprising a power supply for supplying power to the oven, wherein said setting keys are caused to be inoperative when a pre-established period of time has lapsed, said pre-established period of time beginning after said power supply is turned on, or after the heating operation of the article, or after closing of the door, or after depressing a clear key.

8. The microwave oven as defined in claim 1, wherein said plurality of setting keys include a number of different menu keys for individually setting periods of heating time corresponding to said different menu keys and a key for setting variable heating time.

9. The microwave oven as defined in claim 1, wherein said start means comprises adding means for adding said plurality of setting keys being depressed consecutively and each within a pre-established period of time, said start means recognizes the inputs of these keys and said adding means consecutively adds the heating time to be set by these keys and stores the total heating time.

10. A timing control device for a microwave oven for heating or cooking of food, comprising:

input means, for inputting a plurality of time signals, each said time signals representing a distinct period of time;

control means, operatively connected to said input means, for converting each said time signal into a total heating or cooking time and for producing a total timing signal representing said total heating or cooking time;

timer means, responsive to said total timing signal, for controlling the heating or cooking of the food for a period of time, said period of time representing said total heating or cooking time;

detecting means, operatively connected to said timer means and said control means, for detecting an interruption of the heating or cooking of the food and for producing a stop signal, said stop signal representing said interruption; and starting means, operatively connected to said input means and said timing means, for producing a start signal when a first predetermined period of time has lapsed after a last time signal has been received;

said timing means, in response to said start signal, causing the heating or cooking of the food to begin for said total heating or cooking time;

said timing means, in response to said stop signal, suspending the heating or the cooking of the food;

said detecting means producing a resume signal when said interruption has ended;

said control means, in response to said resume signal and new time signals from said input means, causing said timing means to resume the heating or cooking of the food for a remainder of said total heating or cooking time only when said resume signal is present and said new time signal equals to one of the old time signals and said new time signal has been received before a second predetermined period of time has lapsed;

said control means preventing said timing signals from heating or cooking of the food and resetting said total heating or cooking time in said timing means only when said new time signals have not been received before said second predetermined period of time has lapsed;

said control means establishing a new total heating or cooking time only when said new time signals do not equal one of the old time signals and said new time signals have been received before said second predetermined period of time has lapsed, said new total heating or cooking time corresponding to the value of said new time signals, thereby enabling the microwave oven to be constructed without a start key input and enabling the microwave oven operation to be restarted with said new heating or cooking time without a complex clear procedure.

11. The timing control device a claimed in claim 10, further comprising display means for indicating said total heating or cooking time inputted by said input means.

12. A method for controlling operations of a microwave oven, comprising the steps of:

(a) inputting time signals, each representing a distinct period of time;

(b) converting the time signals into a total time for an operation;

(c) starting the operation of the microwave oven after a first predetermined period of time has lapsed, the first predetermined period of time starting after a last time signal has been inputted;

(d) detecting an interruption to the operation of the microwave oven;

(e) restarting the operation of the microwave oven after the interruption is completed only when new time signals are inputted before a lapse of a second predetermined period of time and the new time signals are equal to the old time signals;

(f) starting a new operation of the microwave oven after the interruption is completed only when the new time signals are inputted before the lapse of the second predetermined period of time and the new time signals are not equal to the old time signals; and (g) cancelling the operation of the microwave oven after the interruption is completed and no new time signals are inputted before the lapse of the second predetermined period of time.

* * * * *